US009490053B2

(12) United States Patent
Suzuki et al.

(10) Patent No.: US 9,490,053 B2
(45) Date of Patent: Nov. 8, 2016

(54) R-T-B BASED PERMANENT MAGNET

(71) Applicant: TDK CORPORATION, Tokyo (JP)

(72) Inventors: Kenichi Suzuki, Tokyo (JP); Kyung-Ku Choi, Tokyo (JP); Ryuji Hashimoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 84 days.

(21) Appl. No.: 14/385,921

(22) PCT Filed: Feb. 12, 2014

(86) PCT No.: PCT/JP2014/053110
§ 371 (c)(1),
(2) Date: Sep. 17, 2014

(87) PCT Pub. No.: WO2014/148145
PCT Pub. Date: Sep. 25, 2014

(65) Prior Publication Data

US 2015/0132178 A1 May 14, 2015

(30) Foreign Application Priority Data

Mar. 22, 2013 (JP) ..... 2013-059679

(51) Int. Cl.
*H01F 1/057* (2006.01)
*C22C 38/00* (2006.01)

(52) U.S. Cl.
CPC ..... *H01F 1/057* (2013.01); *C22C 38/002* (2013.01); *C22C 38/005* (2013.01); *H01F 1/0577* (2013.01)

(58) Field of Classification Search
CPC ..... H01F 10/126; H01F 1/057; C22C 38/00
USPC ..... 420/246; 148/101
See application file for complete search history.

(56) References Cited

U.S. PATENT DOCUMENTS 4,765,848 A 8/1988 Mohri et al.
5,129,963 A * 7/1992 Panchanathan ..... H01F 1/0576 148/101

(Continued)

FOREIGN PATENT DOCUMENTS

JP A-59-46008 3/1984
JP A-61-081606 4/1986

(Continued)

OTHER PUBLICATIONS

Written Opinion of the International Searching Authority issued in International Application No. PCT/JP2014/053110 dated Apr. 22, 2014 (with partial translation).
International Search Report issued in International Application No. PCT/JP2014/053110 mailed on Apr. 22, 2014 (with translation).

*Primary Examiner* — Jie Yang
(74) *Attorney, Agent, or Firm* — Oliff PLC

(57) ABSTRACT

A R-T-B based permanent magnet which not only has equivalent magnetic properties as the existing Nd—Fe—B based permanent magnet but also has a high adhesive strength and which can be suitably used as a magnet for field system of a permanent magnet synchronous rotating machine. The magnet can be obtained in a case where the composition of the compound for forming the main phase is $(R_{1-x}(Ce_{1-z}Y_z)_x)_2T_{14}B$ (R is rare earth element(s) consisting of one or more elements selected from La, Pr, Nd, Sm, Eu, Gd, Tb, Dy, Ho, Er, Tm, Yb and Lu, T is one or more transition metal elements with Fe or Fe and Co as essential element(s), $0.0<x\leq0.5$ and $0.0\leq z\leq0.5$), by making the abundance ratio of $Ce_{4f}/(Ce_{4f}+Ce_{4g})$ satisfies $0.8\leq Ce_{4f}/(Ce_{4f}+Ce_{4g})\leq1.0$ when the Ce occupying the 4f site of the tetragonal $R_2T_{14}B$ structure is denoted $Ce_{4f}$ and the Ce occupying the 4g site is denoted as $Ce_{4g}$.

2 Claims, 3 Drawing Sheets

(a) HAADF image (b) crystal structure model

(56) References Cited

U.S. PATENT DOCUMENTS

| | | | | |
|---|---|---|---|---|
| 7,048,808 | B2 * | 5/2006 | Kaneko | H01F 1/058 148/101 |
| 9,111,674 | B2 * | 8/2015 | Hashimoto | H01F 1/057 |
| 2014/0311291 | A1 * | 10/2014 | Enokido | H01F 1/0536 75/246 |
| 2015/0279527 | A1 * | 10/2015 | Suzuki | C22C 38/002 420/83 |
| 2015/0279528 | A1 * | 10/2015 | Suzuki | H01F 1/0577 335/302 |

FOREIGN PATENT DOCUMENTS

| | | |
|---|---|---|
| JP | A-62-122106 | 6/1987 |
| JP | A-62-202506 | 9/1987 |
| JP | A-62-281403 | 12/1987 |
| JP | A-10-163014 | 6/1998 |
| JP | A-2002-285301 | 10/2002 |
| JP | A-2009-302262 | 12/2009 |
| JP | A-2011-187624 | 9/2011 |

* cited by examiner (a) HAADF image (b) crystal structure model

R-T-B BASED PERMANENT MAGNET

The present invention relates to a R-T-B based permanent magnet, and particularly to a permanent magnet with high adhesive property obtained by selectively replacing part of R in the R-T-B based permanent magnet with Ce and Y.

BACKGROUND

The R-T-B based permanent magnet (R is rare earth element(s), T is Fe or Fe with part of which is replaced with Co, and B is boron) having the tetragonal compound $R_2T_{14}B$ as the main phase is known to have excellent magnetic properties and has been a representative permanent magnet with high performance since the invention in 1982 (Patent document 1: JPS59-46008A).

The R-T-B based magnets with the rare earth element(s) R being consisted of Nd, Pr, Dy, Ho and Tb have a large anisotropy magnetic field Ha and are preferably used as permanent magnet materials. Among them, the Nd—Fe—B based magnet having Nd as the rare earth element R is widely used because it has a good balance among saturation magnetization Is, Curie temperature Tc and anisotropy magnetic field Ha, and is superior in resource abundance and corrosion resistance than R-T-B based magnets using other rare earth elements as R.

As a rotating machine widely used in consumer, industry, and transportation equipment, permanent-magnet synchronous rotating machines tend to be used extensively in terms of saving energy and energy density in recent years.

In a permanent-magnet synchronous motor, the surface magnet type rotating machine, which has a permanent magnet adhered on the surface of the rotor, has the advantage of being capable of effectively utilizing the magnetism possessed by the permanent magnet on one hand. And on the another hand, it has a problem that the permanent magnet adhered on the motor may be peeled off due to a centrifugal force under a high rotating speed.

PATENT DOCUMENTS

Patent document 1: JPS59-46008A
Patent document 2: JP2002-285301A;
Patent document 3: JP2009-302262A;
Patent document 4: JP2011-187624A Among R for consisting the R-T-B based permanent magnet, Ce and Y are known as elements of which the stable oxides have a cubic system. Many cubic systems whose interaxial angle is an acute angle as compared with other crystal systems such as hexagonal system and the like, generate an anchoring (adhering) effect on the surface of an oxidized R-T-B based permanent magnet. That is, firm adhesive property can be expected on the boundary with the materials to be plated or adhered. In Patent document 2, (Nd, Ce)-T-B based magnets with the rare earth element(s) R in the R-T-B based magnet being Nd and Ce are disclosed, and a permanent magnet with high magnetic properties can still be obtained even when Nd containing Ce as impurity is used as R without using expensive high-purity Nd. However, as compared with the composition not containing Ce, the coercive force HcJ decreased by about 10% in a composition that contains 8 at. % of Ce relative to Nd, the coercive force HcJ decreased by about 65% in a composition that contains 17 at. % of Ce relative to Nd, etc., and the decrease in the coercive force caused by incorporation of Ce is significant. In Patent document 3, (Ce, R)-T-B based magnets with Ce as an essential element for the rare earth element(s) R of the R-T-B based magnet are disclosed, and the obtained magnet has a coercive force HcJ of about 100 kA/m~300 kA/m by making the ratio of Ce in R being 50 at. % to 90 at. %. In Patent document 4, Y-T-B based magnets with the rare earth element R in the R-T-B based magnet being Y are disclosed, and magnets having a practical coercive force can still be obtained by making the amounts of Y and B larger than the stoichiometric composition of $Y_2Fe_{14}B$, even though the $Y_2Fe_{14}B$ phase having a small anisotropy field Ha is the main phase. However, the Y-T-B based magnet disclosed in Patent document 4 has a Br of about 0.5 to 0.6 T, a HcJ of about 250 to 350 kA/m. The magnetic properties are much lower than those of the Nd—Fe—B based magnet. As mentioned above, it is hard to obtain a magnet with a high coercive force when Ce or Y is contained as the rare earth element(s) R in the R-T-B based permanent magnet.

SUMMARY

The present invention is made on the recognition of such situation and is aimed to provide a permanent magnet which will not significantly reduce the magnetic properties and which has a high adhesive strength as compared with the Nd—Fe—B based magnet widely used in consumer, industry, transportation equipment and etc.

The R-T-B based permanent magnet of this invention is characterized in containing main phase grains with the composition being $(R_{1-x}(Ce_{1-z}Y_z)_x)_2T_{14}B$ (R is rare earth element(s) consisting of one or more elements selected from La, Pr, Nd, Sm, Eu, Gd, Tb, Dy, Ho, Er, Tm, Yb and Lu, T is one or more transition metal elements with Fe or Fe and Co as essential element(s), $0.0<x\leq0.5$ and $0.0\leq z\leq0.5$), wherein the abundance ratio of $Ce_{4f}/(Ce_{4f}+Ce_{4g})$ satisfies $0.8\leq Ce_{4f}/(Ce_{4f}+Ce_{4g})\leq1.0$ when the Ce occupying the 4f site of the tetragonal $R_2T_{14}B$ structure in the main phase grains is denoted as $Ce_{4f}$ and the Ce occupying the 4g site is denoted as $Ce_{4g}$.

The inventors of the present invention found that, in the R-T-B based permanent magnet, a permanent magnet for which the magnetic properties are not reduced in comparison with the existing Nd—Fe—B based permanent magnet and which has high adhesive property can be obtained by making the arrangement of the rare earth elements R occupying specific positions of a lattice to be a suitable arrangement, especially by selectively replacing Nd that exists in the 4f site of the $Nd_2Fe_{14}B$ crystal structure in the Nd—Fe—B based permanent magnet with Ce and Y.

Among R for consisting the R-T-B based permanent magnet, the stable oxides of Ce or Y forms a crystal structure of a cubic system. The cubic systems whose interaxial angle is an acute angle generate an anchoring (adhering) effect on the surface of an oxidized R-T-B based permanent magnet and exhibit high adhesive property. However, due to small magneto crystalline anisotropy, R-T-B based permanent magnet with Ce or Y being the rare earth element(s) R will not form a permanent magnet with high magnetic properties especially coercive force HcJ.

Magneto crystalline anisotropy, as the origin of the coercive force of rare earth based magnets, is generated by the single-ion anisotropy of rare earth ions constraining the entire magnetic moment of the crystal. The single-ion anisotropy of the rare earth ions is determined by the arrangement of atoms and the electron cloud of the ions. For example, in the tetragonal $Nd_2Fe_{14}B$ structure, there are two sites for Nd ions, i.e. 4f site and 4g site. The ion anisotropy of Nd occupying the 4g site is parallel to the entire magnetic anisotropy of the crystal, and thus can contribute to the increase of the magneto crystalline anisotropy. However, the ion anisotropy of Nd occupying the 4f site is orthogonal to the entire magnetic anisotropy of the crystal, and thus is not helpful for increasing the magneto crystalline anisotropy.

The single-ion anisotropy of the rare earth ion that occupies the 4f site is not helpful for increasing the entire magneto crystalline anisotropy of the crystal. That is, for Ce or Y, although its stable oxide is cubic system and high adhesive property can be expected, a high coercive force HcJ cannot be obtained due to the small magneto crystalline anisotropy. If such Ce or Y can be used to perform replacement at 4f site selectively, a permanent magnet which maintains the high magnetic properties possessed by existing $Nd_2Fe_{14}B$, and meanwhile has high adhesive property due to the oxides of Ce or Y can be obtained.

In order to selectively perform replacement with Ce and Y at 4f site of the tetragonal $Nd_2Fe_{14}B$ structure, it is necessary to adjust the interatomic distance such that Ce and Y after replacement are stabilized at 4f site. Since Ce exhibits a variation in the valence number and in the corresponding ionic radius, it is an element more suitable than Y for a selective and stable replacement at 4f site of the tetragonal $Nd_2Fe_{14}B$ structure.

According to the present invention, permanent magnets with a high adhesive strength suitable for use in permanent magnet synchronous rotating machines, especially for use in surface magnet-type rotating machines, for which the magnetic properties are not significantly reduced in comparison with the existing Nd—Fe—B based magnet, can be obtained by partially and selectively replacing R in the R-T-B based permanent magnet with Ce and Y.

BRIEF DESCRIPTION OF THE DRAWINGS

FIG. 1(*b*) is the crystal structure model of the $Nd_2Fe_{14}B$ crystal structure as observed in direction [110].

FIG. 2(*b*) is the line profile of intensity of the HAADF image of the main phase grains having the composition of $(Nd_{0.5}Ce_{0.5})_2Fe_{14}B$ (example 3) as observed in direction [110].

DETAILED DESCRIPTION OF EMBODIMENTS

Figure 1:
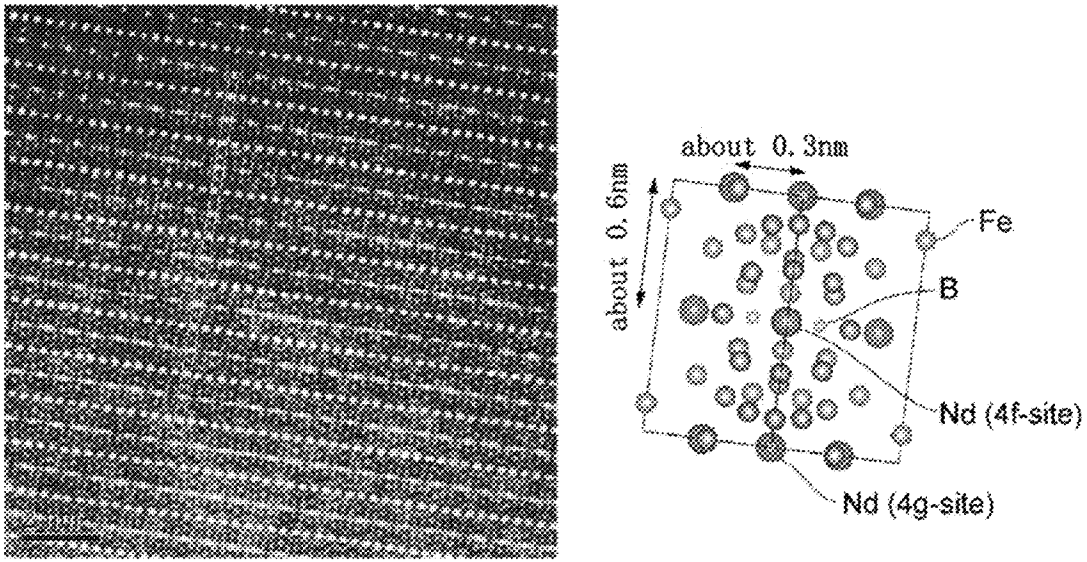
FIG. 1(*a*) is the HAADF image of the main phase grains of the sintered body in the comparative example 1 of the present invention as observed in direction [110].

Hereinafter, the preferred embodiments of the present invention are specifically described. In addition, the embodiments do not limit the invention but are only examples, and all the features and the combinations thereof recited in the embodiments are not necessarily limited to the substantive contents of the invention.

The R-T-B based permanent magnet of this invention is characterized in containing main phase grains with the composition being $(R_{1-x}(Ce_{1-z}Y_z)_x)_2T_{14}B$ (R is rare earth element(s) consisting of one or more elements selected from La, Pr, Nd, Sm, Eu, Gd, Tb, Dy, Ho, Er, Tm, Yb and Lu, T is one or more transition metal elements with Fe or Fe and Co as essential elements, $0.0<x\leq0.5$ and $0.0\leq z\leq0.5$), wherein the abundance ratio of $Ce_{4f}/(Ce_{4f}+Ce_{4g})$ satisfies $0.8\leq Ce_{4f}/(Ce_{4f}+Ce_{4g})\leq1.0$ when the Ce occupying the 4f site of the tetragonal $R_2T_{14}B$ structure in the above main phase grains is denoted as $Ce_{4f}$ and the Ce occupying the 4g site is denoted as $Ce_{4g}$.

In the present embodiments, R is rare earth element(s) consisting of one or more elements selected from La, Pr, Nd, Sm, Eu, Gd, Tb, Dy, Ho, Er, Tm, Yb and Lu.

In the present embodiments, the sum amount x occupied by Ce and Y in the composition of the main phase grains satisfies $0.0<x\leq0.5$. With x increasing, the amount of Ce and Y whose stable oxides are cubic systems increases, and the adhesive strength of the magnet increases. However, if x exceeds 0.5, the magnetic properties of the resultant sample decreases significantly.

In the present embodiments, the relative amount z between Ce and Y satisfies $0.0\leq z\leq0.5$. Since Ce exhibits a variation in the valence number and in the corresponding ionic radius, it is preferably used as the element for selectively and stably performing a replacement at 4f site of the tetragonal $Nd_2Fe_{14}B$ structure. However, it is not necessary to replace all the 4f site with Ce in order to adjust the distance between adjacent atoms, and replacement with only a suitable amount ($0.0\leq z\leq0.5$) of Y together with Ce may be performed to R. Y, which is an element with the lowest atomic weight among those selected as R in the tetragonal $R_2T_{14}B$ structure and accordingly renders the magnet light, has the effect of reducing the centrifugal force applied on the permanent magnet and preventing peel off in a surface magnet-type permanent magnet synchronous rotating machine.

In the present embodiments, B may have a part thereof replaced by C. Preferably, the replacing amount of C is 10 at. % or less relative to B.

In the present embodiments, T, which forms the balance, is one or more transition metal elements with Fe or Fe and Co as essential element(s). Preferably, the amount of Co is 0 at. % or more and 10 at. % or less relative to the amount of T. By addition of the Co amount, the Curie temperature can be increased and the decrease of coercive force corresponding to the increase of the temperature can be inhibited to be low. In addition, by addition of the Co amount, the corrosion resistance of the rare earth based permanent magnet can be increased.

Hereinafter, the preferred examples of the manufacturing method of the present invention are described.

In the manufacture of the R-T-B based permanent magnet of the present embodiment, alloy raw materials for obtaining the R-T-B based magnet with the desired composition are firstly prepared. The alloy raw materials can be made by a strip casting method or by other known melting methods in vacuum or in inert gas preferably Ar atmosphere. The strip casting method sprays the molten metal obtained by melting the metal raw materials in non-oxidizing atmosphere such as Ar atmosphere and the like to the surface of the rotating roller. The quenched molten metal on the roller is quenched and solidified into a thin plate or a thin sheet (squama) shape. Said quenched and solidified alloy has a homogeneous composition with the crystal particle diameter being 1~50 μm. The alloy raw materials can be obtained, not limited to the strip casting method, but also by melting methods such as high frequency induction melting and the like. In addition, in order to prevent segregation after melting, they may be poured to for example water-cooled copper plates so as to be solidified. Further, alloys obtained by a reduction diffusion method may also be used as the raw material alloys.

In the case of obtaining the R-T-B based permanent magnet in the present invention, for the alloy raw materials, substantially, the so-called single-alloy method for manufacturing a magnet from alloy of one kind of metal may suitably be used, but the so-called mixing method may also be suitably used, which uses a main phase alloy and a alloy contributing to effective formation of the grain boundary. The main phase alloy (low-R alloy) has the main phase grains (i.e., $R_2T_{14}B$ crystals) as the main part while the alloy contributing to effective formation of the grain boundary (high-R alloy) contains more R than the low-R alloy.

The alloy raw materials are supplied to a pulverization step. In a case where the mixing method is used, the low-R alloy and the high-R alloy are pulverized separately or pulverized together. The pulverization step includes a coarse pulverization step and a fine pulverization step. Firstly, the alloy raw materials are coarsely pulverized until the particle diameter is approximately several hundreds of micrometers. The coarse pulverization is preferably performed using a stamp mill, a jaw crusher, a Brown mill and the like under inert gas atmosphere. Before coarse pulverization, it is more effective to perform pulverizing by allowing the raw material alloy adsorbed with hydrogen and then released the hydrogen. The hydrogen-releasing treatment is performed aiming to reduce hydrogen that forms into the impurities of the rare earth based sintered magnet. The maintained heating temperature for hydrogen adsorption is 200° C. or more, preferably 350° C. or more. The maintaining time varies depending on the relationship with maintained temperature, the thickness of the alloy raw material and etc., but it is at least 30 min or more, preferably 1 hour or more. The hydrogen-releasing treatment is preformed in vacuum or in a flow of Ar gas. Further, the hydrogen-adsorbing treatment and the hydrogen-releasing treatment are not necessary treatments. The hydrogen pulverization can also be the coarse pulverization to omit a mechanical coarse pulverization.

After the coarse pulverization process, the resultant is transferred to the fine pulverization process. During the fine pulverization, a jet mill is mainly used to pulverize the coarsely pulverized powder having a particle diameter of approximately several hundreds of micrometers to an average particle diameter of 2.5~6 μm, preferably 3~5 μm. The jet mill adopts, for performing pulverization, a method of discharging high-pressure inert gas from a narrow nozzle to produce a high-speed gas flow, via which the coarsely pulverized powder is accelerated, thereby causing collision between the coarsely pulverized powders or collision with a target or a container wall.

The wet pulverization can also be used in the fine pulverization. In the wet pulverization, a ball mill, or a wet attritor, or the like is used to pulverize the coarsely pulverized powder having a particle diameter of approximately several hundreds of micrometers to an average particle diameter of 1.5~5 μm, preferably 2~4.5 μm. By selecting a suitable dispersion medium in the wet pulverization, the powder of the magnet can be pulverized without contacting oxygen, and thus fine powder with a low concentration of oxygen can be obtained.

During the fine pulverization, a fatty acid or a fatty acid derivative or a hydrocarbon, for example, stearic acids or oleic acids such as zinc stearate, calcium stearate, aluminum stearate, stearic amide, oleic amide, ethylene bis-isostearic amide; hydrocarbons such as paraffin, naphthalene and the like, can be added at about 0.01~0.3 wt % for the purpose of improving the lubrication and orientation properties in molding.

The finely pulverized powder is supplied to the molding process in a magnetic field. The molding pressure when molding in the magnetic field may be in a range of 0.3~3 ton/cm$^2$ (30~300 MPa). The molding pressure may be constant from the beginning of the molding to the end, and may also be increased or decreased gradually, or it may be irregularly varied. The lower the molding pressure, the better the orientation property. However, if the molding pressure is too low, problems will occur during handling due to insufficient strength of the molded article, thus the molding pressure is selected from the above range in this consideration. The final relative density of the molded article obtained by molding in the magnetic field is usually 40~60%.

The magnetic field is applied at about 960~1600 kA/m (10~20 kOe). The applied magnetic field is not limited to a static magnetic field, and it may also be a pulsed magnetic field. In addition, a static magnetic field and a pulsed magnetic field may be used together.

Subsequently, the molded article is provided to the sintering process. Sintering is conducted in vacuum or under inert gas atmosphere. The sintering maintaining temperature and the sintering maintaining time need to be adjusted according to conditions such as the composition, the pulverization method, the difference in average particle diameter and in grain size distribution and the like, and the sintering may simply be maintained at about 1000~1200° C. for 2 hours to 20 hours. The resultant is transferred to a temperature lowering process after a suitable maintaining period. And the temperature lowering rate may be $10^{-4}$° C./sec~$10^{-2}$° C./sec. At this time, the temperature lowering rate does not need to be always constant from the maintaining temperature until the room temperature, as long as it is controlled within the above range in a specified temperature zone. The temperature of the zone for which the temperature lowering rate is to be controlled is determined by the composition, and is about 400° C. to 800° C. The inventors believe that various elements contained in the composition may be in a configuration with the most stable structure by controlling the temperature lowering rate in the specified temperature zone determined by the composition and thereby the characteristic structure of this invention is formed. That is, making the temperature lowering rate sufficiently low is a necessity for realizing the invention, and the temperature lowering rate needs at least to be lower than $10^{-2}$° C./sec. However, a temperature lowering rate lower than $10^{-4}$° C./sec will lead to a significant decrease in the manufacturing efficiency, and thus is not realistic.

After sintering, the obtained sintered body may be subjected to an aging treatment. The aging treatment process is a process effective in increasing the coercive force. However, when the aging treatment is conducted at a temperature in the vicinity of the above temperature zone for which the temperature lowering rate needs to be controlled, it is effective to control the cooling rate from the aging temperature also within the above range of the temperature lowering rate.

Hereinabove, the embodiments for best implementing the manufacturing methods of the present invention are described. Next, regarding the R-T-B based permanent magnet of the present invention, descriptions are provided in terms of the methods for analyzing the composition of the main phase grains and the occupying positions of the rare earth element(s) in the $R_2T_{14}B$ crystal structure.

In the present invention, the composition of the R-T-B based permanent magnet may be determined by energy dispersive X-ray analysis. The sintered body which is the sample is cut off in a direction perpendicular to the axis of easy magnetization (i.e., the direction in which the magnetic filed is applied when performing molding), and after it is determined that the main generation phase belongs to the tetragonal $R_2T_{14}B$ structure via X ray diffraction, the sintered body is processed to be a thin sheet shape with a thickness of 100 nm in a Focused Ion Beam (FIB) device. The vicinity of the center of the main phase grains is analyzed in the Energy Dispersive Spectroscopy (EDS) equipped on the Scanning Transmission Electron Microscope (STEM), and the composition of the main phase grains can be quantified by using the film correcting function.

The EDS device can hardly quantify B due to the low sensitivity to light elements. In this regard, the composition of the main phase grains is determined by the composition ratio of elements other than B based on the condition that the main generation phase is determined to be tetragonal $R_2T_{14}B$ structure via X ray diffraction in advance.

The composition of the main phase grains quantified by the above method may be controlled by adjusting the composition of the entire sintered body sample. The results obtained by comparing the composition of the entire sintered body sample obtained by Inductively Coupled High Frequency Plasma Spectrometry Analysis (ICP Spectrometry Analysis: Inductively Coupled Plasma Spectrometry) with the composition of the main phase grains obtained by the EDS device shows a tendency of a higher content of rare earth elements in the composition of the entire sintered body sample. This is because the sintered body sample needs to contain more rare earth based elements than the stoichiometric composition of $R_2T_{14}B$ in order to cause densification and formation of the grain boundary by sintering. However, regarding the ratio of the rare earth element(s) contained as R, the composition of the entire sintered body sample is substantially the same as that of the main phase grains. That is, by adjusting the composition of the entire sintered body sample, the ratio of the rare earth element(s) contained as R in the main phase grains $R_2T_{14}B$ may be controlled.

The abundance ratio of $Ce_{4f}/(Ce_{4f}+Ce_{4g})$ in relation to the Ce occupying the 4f site of the tetragonal $R_2T_{14}B$ structure (i.e., $Ce_{4f}$) and the Ce occupying the 4g site (i.e., $Ce_{4g}$) satisfies $0.8 \leq Ce_{4f}/(Ce_{4f}+Ce_{4g}) \leq 1.0$. The present invention is characterized in that, a permanent magnet that exhibits high adhesive property, with the excellent magnetic properties of $Nd_2Fe_{14}B$ maintained, can be obtained by only replacing Nd occupying the 4f site by Ce or Y whose stable oxide is a cubic system. The above Nd occupying the 4f site does not contribute to the improvement of the uniaxial anisotropy of the entire crystal due to the ion anisotropy in a direction perpendicular to the anisotropy of $Nd_2Fe_{14}B$. Due to the equivalent amounts of 4f site and 4g site in the $Nd_2Fe_{14}B$ crystal, $Ce_{4f}/(Ce_{4f}+Ce_{4g})=1.0$ if all the 4f site is replaced by Ce, forming an optimal embodiment of the present invention. However, it is not necessary to replace all the 4f site with Ce in reality, and a magnet exhibiting sufficiently applicable magnetic properties can be obtained in the range $0.8 \leq Ce_{4f}/(Ce_{4f}+Ce_{4g}) \leq 1.0$.

The abundance ratio of $Ce_{4f}/(Ce_{4f}+Ce_{4g})$ in relation to the Ce occupying the 4f site of the above tetragonal $R_2T_{14}B$ structure (i.e., $Ce_{4f}$) and the Ce occupying the 4g site (i.e., $Ce_{4g}$) may be determined by the High-Angle Annular Dark-Field image obtained by a scanning transmission electron microscope.

After the sintered body is cut off in a direction perpendicular to the axis of easy magnetization in which the magnetic field is applied when performing molding and the sintered body is processed to be a thin sheet shape with a thickness of 100 nm by an FIB device, the sample is adjusted to a position in STEM where the $Nd_2Fe_{14}B$-type crystal structure can be observed in the [110] direction, to obtain a High-Angle Annular Dark-Field (HAADF) image. FIG. 1 exemplifies the (a) HAADF image and the (b) crystal structure model as observed in direction [110] obtained from the sintered body of which the composition of the main phase grains is $Nd_2Fe_{14}B$.

Figure 2:
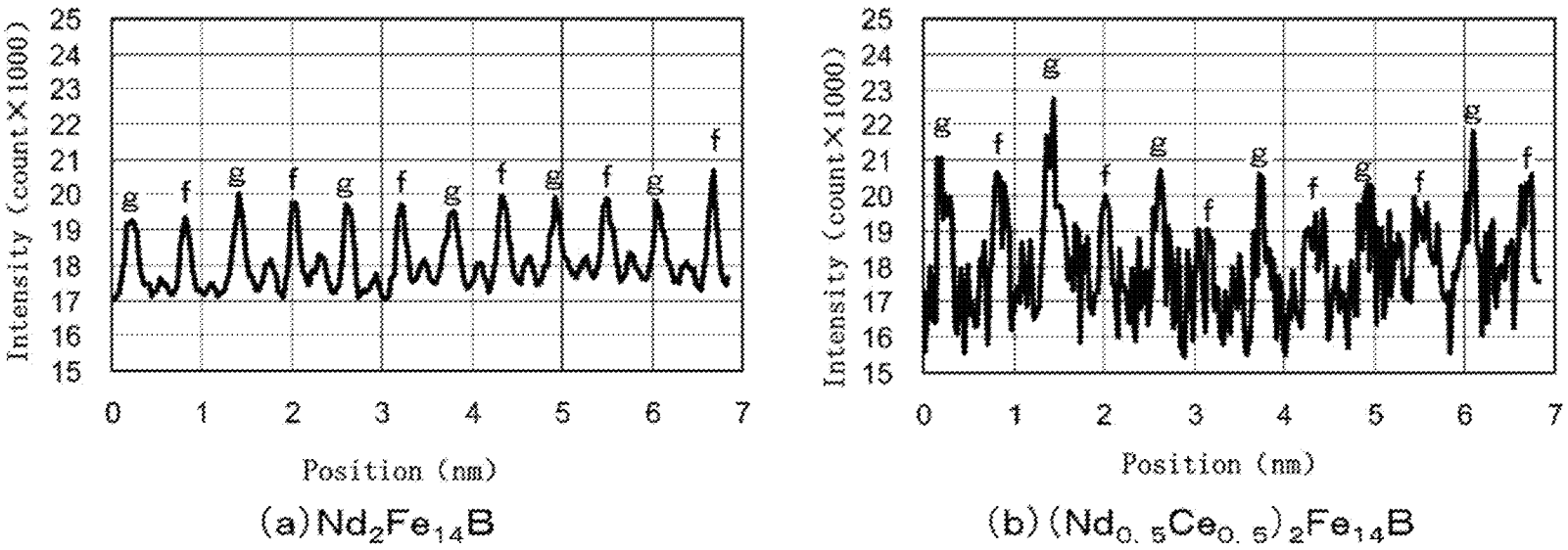
FIG. 2(*a*) is the line profile of intensity of the HAADF image of the main phase grains having the composition of $Nd_2Fe_{14}B$ (comparative example 1) as observed in direction [110].

In the above HAADF image, the intensity is roughly proportional to the square of the atomic number, and thus the elements occupying the sites can be determined. Particularly, 4f site and 4g site can be separated clearly without overlapping when the $Nd_2Fe_{14}B$-type crystal structure is observed in direction [110]. The line profiles of the intensity obtained from the HAADF images of the sintered bodies each having a composition of (a) $Nd_2Fe_{14}B$ and (b) $(Nd_{0.5}Ce_{0.5})_2Fe_{14}B$ are shown in FIG. 2. In addition, the line profiles are obtained along the rectangular region shown in the HAADF image of FIG. 1(*a*).

In the HAADF image of the $Nd_2Fe_{14}B$ crystal as observed in direction [110] shown in FIG. 2(*a*), both the intensity of 4f site and 4g site are high and they have equivalent intensity, and thus it can be determined that both the 4f site and 4g site are occupied by Nd which have a large atomic number.

In the HAADF image of the $(Nd_{0.5}Ce_{0.5})_2Fe_{14}B$ crystal as observed in direction [110] shown in FIG. 2(*b*), the intensity in 4f site is low while that in 4g site is high. That is, it can be determined that Ce having a lower atomic number occupies the 4f site while Nd having a larger atomic number occupies the 4g site.

EXAMPLES

Hereinafter, the contents of the present invention are further specifically described based on the examples and comparative examples, but the present invention are not completely limited to the following examples.

Specified amounts of Nd metal, Y metal, Ce metal, electrolytic iron and ferroboron were weighted to make the composition of the main phase grains to be $(Nd_{1-x}(Ce_{1-z}Y_z)_x)_2Fe_{14}B$ (x=0.0~0.7, z=0.0~1.0), and a thin-plate shaped R-T-B alloy was manufactured via a strip casting method. After subjecting said alloy to stirring in a hydrogen gas flow with a simultaneous heating treatment to prepare coarse powder, an oleic amide was added as a lubricant, and fine powder was prepared in a non-oxidizing atmosphere with a jet mill (the average particle diameter being 3 μm). The resultant fine powder was filled into a mold (with an opening size of 20 mm×18 mm) and subjected to uniaxial pressing molding with a pressure of 2.0 ton/cm$^2$ under a magnetic field (2T) applied in a direction perpendicular to the pressing direction. After the resultant molded article was heated to the optimal sintering temperature and maintained for 4 hours, the resultant was cooled to room temperature to obtain the sintered body, wherein the temperature decreasing rate in a temperature zone of ±50° C. centered at 400° C. to 800° C. was made to be $1\times10^{0}$° C./sec~$5\times10^{-5}$° C./sec, and the temperature decreasing rate in a temperature zone other than the above was $10^{-1}$° C./sec. The results obtained by determining the magnetic properties of the sintered body with a B—H tracer were shown in Table 1.

The sintered body was cut off in a direction perpendicular to the axis of easy magnetization (i.e., the direction in which the magnetic filed was applied when performing molding), and it was determined that the main generation phase belonged to the tetragonal $R_2T_{14}B$ structure via X ray diffraction method. Subsequently, after the sintered body was processed to be a thin sheet shape with a thickness of 100 nm by an FIB device, the vicinity of the center of the main phase grains was analyzed with the EDS device equipped to the STEM, and the composition of the main phase grains was quantified by using the film correcting function. Next, the sample was adjusted to a position where the tetragonal $R_2T_{14}B$ structure could be observed from direction [110], to obtain an HAADF image. Targeting at the square area in the HAADF image, of which the length of each side was 10 nm, the abundance ratio of $Ce_{4f}/(Ce_{4f}+Ce_{4g})$ in relation to the Ce occupying the 4f site of the tetragonal $R_2T_{14}B$ structure (i.e., $Ce_{4f}$) and the Ce occupying the 4g site (i.e., $Ce_{4g}$), which was obtained by counting the numbers of Ce occupying the f site and g site based on the intensity information, were shown in Table 1.

Figure 3:
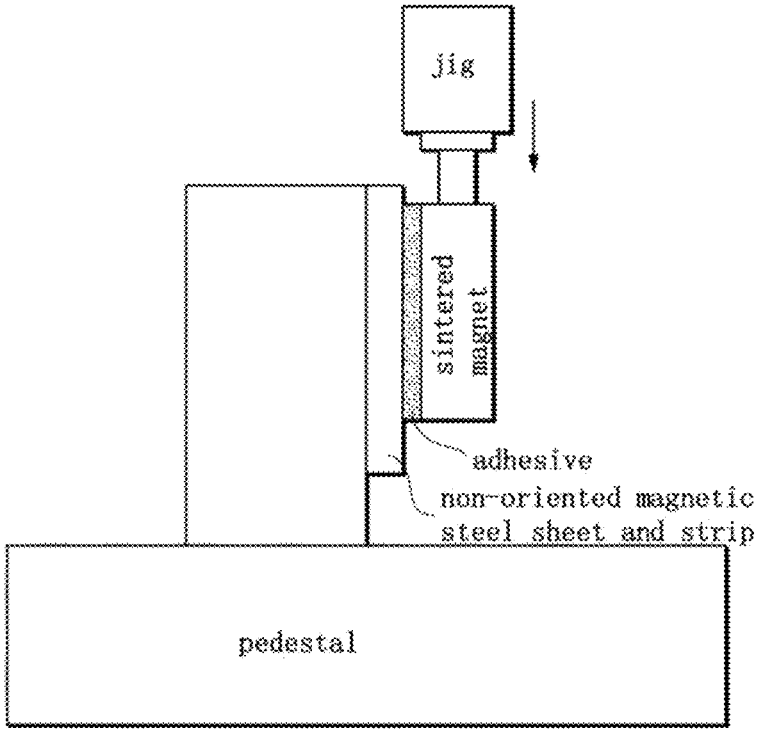
FIG. 3 is a rough sketch representing the method for measuring the compression-shear stress used as an evaluation of the adhesive strength of the sintered body.

The adhesive strength of the sintered body was evaluated by the compression-shear stress. The sintered body serving as the sample was processed into a test piece with a specified shape (diameter 12 mm×thickness 3 mm), and fixed on the rotor of a permanent magnet synchronous rotating machine (non-oriented magnetic steel sheet and strip) with a heat-curable epoxy adhesive (curing condition: 150° C., 4 hours) in a manner of allowing the thickness of the adhesive to be 0.1 mm (FIG. 3). Subsequently, a stress was applied to the sintered body and the non-oriented magnetic steel sheet and strip at a speed of 10 mm/min to apply a compression-shear stress to the adhesive, and the stress by which the sintered body peels off from the boundary of the adhesive was treated as the adhesive strength. The average of ten measurements of the adhesive strength of the sintered body was shown in Table 1.

Examples 1~3, and Comparative Examples 1~3

In a composition in which the R in the tetragonal $R_2T_{14}B$ structure was Nd and replaced with only Ce (x=0.0~0.7, z=0.1), although the residual magnetic flux density $B_r$ and the coercive force $H_{cJ}$ decreased gradually as the replacement amount x of Ce relative to Nd increased, the adhesive strength increased. However, when x≥0.6, the improvement of the adhesive strength reached a saturation state even though it was found that the residual magnetic flux density $B_r$ and the coercive force $H_{cJ}$ decreased gradually. That was, it could be known that in a case where Nd was replaced with only Ce (z=0.0), within the range of 0.0<x≤0.5, the reduce in the magnetic properties could be slightly inhibited in comparison with the existing Nd—Fe—B based magnet, and a permanent magnet with a high adhesive strength could be obtained. In addition, it could be known that, within the above range, the abundance ratio of $Ce_{4f}/(Ce_{4f}+Ce_{4g})$ in relation to the Ce occupying the 4f site (i.e., $Ce_{4f}$) and the Ce occupying the 4g site (i.e., $Ce_{4g}$) was 0.86~0.91, and most Ce that replaced Nd selectively occupied the 4f site.

Comparative Examples 9~13

In a composition in which the R in the tetragonal $R_2T_{14}B$ structure was Nd and replaced with only Y (x=0.2~0.7, z=1.0), the adhesive strength increased as the replacement amount x of Y relative to Nd increased. However, the increasing extent of the adhesive strength was relatively small as compared to that by replacement of only Ce (z=0.0). That was, it could be known that when Nd was replaced with only Y (z=1.0), the resultant permanent magnet did not have practical residual magnetic flux density $B_r$ and coercive force $H_{cJ}$, and it did not have a high adhesive strength, either.

Examples 4~6 and Comparative Examples 5~6

In a composition in which the R in the tetragonal $R_2T_{14}B$ structure was Nd and replaced with Ce and Y in half and half (x=0.2~0.7, z=0.5), the adhesive strength increased as the replacement amount x of Ce and Y relative to Nd increased. However, the improvement of the adhesive strength was saturated when x≥0.6. Inaddition, the residual magnetic flux density $B_r$ and the coercive force $H_{cJ}$ decreased sharply. That was, it could be known that in a composition in which Nd was replaced with Ce and Y in half and half (z=0.5), within the range 0.0<x≤0.5, a permanent magnet which not only had equivalent magnetic properties as the existing Nd—Fe—B based magnet but also had a high adhesive strength was obtained. Further, it could be known that in the above range, the abundance ratio of $Ce_{4f}/(Ce_{4f}+Ce_{4g})$ in relation to the Ce occupying the 4f site (i.e., $Ce_{4f}$) and the Ce occupying the 4g site (i.e., $Ce_{4g}$) was 0.87~0.88, and most Ce that replaced Nd selectively occupied the 4f site.

Examples 3, Examples 6~8, Comparative Examples 7~8 and Comparative Example 11

In a composition in which the R in the tetragonal $R_2T_{14}B$ structure was Nd and a half of Nd was replaced with Y or Ce or both (x=0.5, z=0.0~1.0), although the residual magnetic flux density $B_r$ and the coercive force $H_{cJ}$ increased gradually as the relative amount of Y relative to Ce increased, the adhesive strength decreased.

In addition, if the relative amount of Y against Ce exceeded a half (z≥0.6), the adhesive strength decreased significantly, however, the improvement of the residual magnetic flux density $B_r$ and the coercive force $H_{cJ}$ exhibited a tendency of being substantially saturated. That was, it could be known that in the range 0.0≤z≤0.5, a permanent magnet that not only had magnetic properties no worse than that of the existing Nd—Fe—B based magnet but also had a higher adhesive strength could be obtained.

Further, it could be known that in the above range, the abundance ratio of $Ce_{4f}/(Ce_{4f}+Ce_{4g})$ in relation to the Ce occupying the 4f site (i.e., $Ce_{4f}$) and the Ce occupying the 4g site (i.e., $Ce_{4g}$) was 0.86~0.88, and most Ce that replaced Nd selectively occupied the 4f site.

Example 3, Examples 11~12 and Comparative Examples 14~18

In a composition in which the R in the tetragonal $R_2T_{14}B$ structure was Nd and a half of Nd was replaced with only Ce (x=0.5, z=0.0), the temperature decreasing rate in a temperature zone of 550° C. ~650° C. (600±50° C.) was made to be varying between $1\times10^{0\circ}$ C./sec and $5\times10^{-5\circ}$ C./sec. It could be known that even under a case with any of the temperature decreasing rates, the adhesive strength was still higher than that of the Nd—Fe—B based magnet with no replacement of Nd (comparative example 1), and the adhesive strength did not greatly depend on the temperature decreasing rate. However, if considered in terms of the magnetic properties, the magnetic properties decreased sharply when the temperature decreasing rate was larger than $2\times10^{-2\circ}$ C./sec, and the abundance ratio of $Ce_{4f}/(Ce_{4f}+Ce_{4g})$ in relation to the $Ce_{4f}$ occupying the 4f site of the tetragonal $R_2T_{14}B$ structure and the $Ce_{4g}$ occupying the 4g site also decreased. The inventors of the present invention believed that the drastic decrease of the magnetic properties accompanied with the increase of the temperature decreasing rate was caused by the insufficient time for movement of rare earth elements towards stable positions. In addition, when the temperature decreasing rate was lower than $1\times10^{-4\circ}$ C./sec, although the magnetic properties had a slight decrease, the abundance ratio of $Ce_{4f}/(Ce_{4f}+Ce_{4g})$ in relation to the $Ce_{4f}$ occupying the 4f site of the tetragonal $R_2T_{14}B$ structure and the $Ce_{4g}$ occupying the 4g site was substantially maintained. The inventors of this invention considered that the decrease of the magnetic properties accompanied with the decrease of the temperature decreasing rate was not caused by the occupancy of Ce at 4f site, but by the disappearance of the crystal boundary structure caused by the excessively low temperature decreasing rate, because of that the crystal boundary structure was needed for allowing the $R_2T_{14}B$ type permanent magnet to exhibit a coercive force.

Example 3 and Comparative Examples 19~22

In a composition in which the R in the tetragonal $R_2T_{14}B$ structure was Nd and a half of Nd was replaced with only Ce (x=0.5, z=0.0), a temperature zone having a temperature decreasing rate of $1\times10^{-2\circ}$ C./sec was made to be varied between 350° C. and 850° C. (400±50° C.~800±50° C.). When the temperature zone having a temperature decreasing rate of $1\times10^{-2\circ}$ C./sec was at 550° C.~650° C. (600±50° C.), equivalently excellent magnetic properties as that of the Nd—Fe—B based magnet with no replacement of Nd (comparative example 1) were obtained. However, when the temperature zone having a temperature decreasing rate of $1\times10^{-2\circ}$ C./sec was at a temperature lower than 550° C.~650° C. (600±50° C.), the magnetic properties decrease and the abundance ratio of $Ce_{4f}/(Ce_{4f}+Ce_{4g})$ in relation to the $Ce_{4f}$ occupying the 4f site of the tetragonal $R_2T_{14}B$ structure and the $Ce_{4g}$ occupying the 4g site also decreased. The inventors of the present invention believed that the decrease of the magnetic properties accompanied with the temperature lowering of the temperature zone for which the temperature decreasing rate was controlled was caused by the insufficient energy for movement of rare earth elements towards stable positions. In addition, when the temperature zone having a temperature decreasing rate of $1\times10^{-2\circ}$ C./sec was at a temperature higher than 550° C.~650° C. (600±50° C.), the magnetic properties decreased and the abundance ratio of $Ce_{4f}/(Ce_{4f}+Ce_{4g})$ in relation to the $Ce_{4f}$ occupying the 4f site of the tetragonal $R_2T_{14}B$ structure and the $Ce_{4g}$ occupying the 4g site also decreased. The inventors believed that, the decrease of the magnetic properties accompanied with the temperature elevating of the temperature zone for which the temperature decreasing rate was controlled was attributed to excessive energy which caused the movement of rare earth elements away from adjacent positions.

Example 6 and Comparative Examples 23~26

In a composition in which the R in the tetragonal $R_2T_{14}B$ structure was Nd and a half of Nd was replaced with Ce and Y (x=0.5, z=0.5), a temperature zone having a temperature decreasing rate of $1\times10^{-2\circ}$ C./sec was made to be varied between 350° C. and 850° C. (400±50° C.~800±50° C.). When the temperature zone having a temperature decreasing rate of $1\times10^{-2\circ}$ C./sec was at 550° C.~650° C. (600±50° C.), equivalently excellent magnetic properties as that of the Nd—Fe—B based magnet with no replacement of Nd (comparative example 1) were obtained. However, when the temperature zone having a temperature decreasing rate of $1\times10^{-2\circ}$ C./sec was at a temperature lower than 550° C.~650° C. (600±50° C.), the magnetic properties decreased and the abundance ratio of $Ce_{4f}/(Ce_{4f}+Ce_{4g})$ in relation to the $Ce_{4f}$ occupying the 4f site of the tetragonal $R_2T_{14}B$ structure and the $Ce_{4g}$ occupying the 4g site also decreased. In addition, when the temperature zone having a temperature decreasing rate of $1\times10^{-2\circ}$ C./sec was at a temperature higher than 550° C.~650° C. (600±50° C.), likewise, the magnetic properties decreased and the abundance ratio of $Ce_{4f}/(Ce_{4f}+Ce_{4g})$ in relation to the $Ce_{4f}$ occupying the 4f site of the tetragonal $R_2T_{14}B$ structure and the $Ce_{4g}$ occupying the 4g site also decreased. The inventors believed that, the decrease of the magnetic properties accompanied with the temperature elevating of the temperature zone for which the temperature decreasing rate was controlled was attributed to excessive energy which caused the movement of rare earth elements away from adjacent positions.

Example 3 and Examples 9~10

It was known that when the R in the tetragonal $R_2T_{14}B$ structure was Nd and when R was Nd and Dy, or Nd and Tb, a permanent magnet that had a higher adhesive strength than the Nd—Fe—B based magnet without replacement of Nd (comparative example 1) could always be obtained by replacing a half of R with only Ce (x=0.5, z=0.0). In addition, it could be known that in the above composition, the abundance ratio of $Ce_{4f}/(Ce_{4f}+Ce_{4g})$ in relation to the Ce occupying the 4f site (i.e., $Ce_{4f}$) and the Ce occupying the 4g site (i.e., $Ce_{4g}$) was 0.85~0.86, and most Ce that replaces R selectively occupied the 4f site.

TABLE 1

| | composition of the main phase grains | x | z | temperature decreasing rate ° C./sec | temperature controling zone ±50° C. | $B_r$ mT | $H_{cJ}$ kA/m | adhesive strength MPa | $Ce_{4f}/(Ce_{4f}+C$ |
|---|---|---|---|---|---|---|---|---|---|
| Ex. 1 | $(Nd_{0.80}Ce_{0.20})_2Fe_{14}B$ | 0.2 | 0.0 | 1.0E−02 | 600 | 1150 | 848 | 32.10 | 0.91 |
| Ex. 2 | $(Nd_{0.60}Ce_{0.40})_2Fe_{14}B$ | 0.4 | 0.0 | 1.0E−02 | 600 | 1015 | 640 | 35.31 | 0.86 |
| Ex. 3 | $(Nd_{0.50}Ce_{0.50})_2Fe_{14}B$ | 0.5 | 0.0 | 1.0E−02 | 600 | 870 | 601 | 35.84 | 0.86 |
| Ex. 4 | $(Nd_{0.80}Ce_{0.10}Y_{0.10})_2Fe_{14}B$ | 0.2 | 0.5 | 1.0E−02 | 600 | 1171 | 966 | 32.04 | 0.88 |
| Ex. 5 | $(Nd_{0.60}Ce_{0.20}Y_{0.20})_2Fe_{14}B$ | 0.4 | 0.5 | 1.0E−02 | 600 | 1137 | 893 | 33.68 | 0.87 |
| Ex. 6 | $(Nd_{0.50}Ce_{0.25}Y_{0.25})_2Fe_{14}B$ | 0.5 | 0.5 | 1.0E−02 | 600 | 1096 | 952 | 34.00 | 0.87 |
| Ex. 7 | $(Nd_{0.50}Ce_{0.40}Y_{0.10})_2Fe_{14}B$ | 0.5 | 0.2 | 1.0E−02 | 600 | 904 | 656 | 35.01 | 0.88 |
| Ex. 8 | $(Nd_{0.50}Ce_{0.30}Y_{0.20})_2Fe_{14}B$ | 0.5 | 0.4 | 1.0E−02 | 600 | 989 | 873 | 34.68 | 0.87 |
| Ex. 9 | $(Nd_{0.49}Dy_{0.01}Ce_{0.5})_2Fe_{14}B$ | 0.5 | 0.0 | 1.0E−02 | 600 | 897 | 880 | 34.39 | 0.86 |
| Ex. 10 | $(Nd_{0.49}Tb_{0.01}Ce_{0.5})_2Fe_{14}B$ | 0.5 | 0.0 | 1.0E−02 | 600 | 815 | 1035 | 35.94 | 0.85 |
| Ex. 11 | $(Nd_{0.50}Ce_{0.50})_2Fe_{14}B$ | 0.5 | 0.0 | 1.0E−03 | 600 | 821 | 628 | 35.83 | 0.87 |
| Ex. 12 | $(Nd_{0.50}Ce_{0.50})_2Fe_{14}B$ | 0.5 | 0.0 | 1.0E−04 | 600 | 793 | 589 | 36.02 | 0.83 |
| Com. Ex. 1 | $Nd_2Fe_{14}B$ | 0.0 | 0.0 | 1.0E−02 | 800 | 1210 | 960 | 30.26 | — |

TABLE 1-continued

| | composition of the main phase grains | x | z | temperature decreasing rate ° C./sec | temperature controling zone ±50° C. | $B_r$ mT | $H_{cJ}$ kA/m | adhesive strength MPa | $Ce_{4f}/(Ce_{4f}+C$ |
|---|---|---|---|---|---|---|---|---|---|
| Com. Ex. 2 | $(Nd_{0.40}Ce_{0.60})_2Fe_{14}B$ | 0.6 | 0.0 | 1.0E−02 | 600 | 837 | 509 | 35.78 | 0.83 |
| Com. Ex. 3 | $(Nd_{0.30}Ce_{0.70})_2Fe_{14}B$ | 0.7 | 0.0 | 1.0E−02 | 600 | 724 | 469 | 35.31 | 0.82 |
| Com. Ex. 4 | $(Nd_{0.40}Ce_{0.48}Y_{0.12})_2Fe_{14}B$ | 0.6 | 0.2 | 1.0E−02 | 600 | 602 | 499 | 35.09 | 0.81 |
| Com. Ex. 5 | $(Nd_{0.40}Ce_{0.30}Y_{0.30})_2Fe_{14}B$ | 0.6 | 0.5 | 1.0E−02 | 600 | 914 | 840 | 33.45 | 0.82 |
| Com. Ex. 6 | $(Nd_{0.30}Ce_{0.35}Y_{0.35})_2Fe_{14}B$ | 0.7 | 0.5 | 1.0E−02 | 600 | 800 | 628 | 34.20 | 0.69 |
| Com. Ex. 7 | $(Nd_{0.50}Ce_{0.20}Y_{0.30})_2Fe_{14}B$ | 0.5 | 0.6 | 1.0E−02 | 600 | 1093 | 944 | 32.99 | 0.90 |
| Com. Ex. 8 | $(Nd_{0.50}Ce_{0.10}Y_{0.40})_2Fe_{14}B$ | 0.5 | 0.8 | 1.0E−02 | 600 | 1099 | 994 | 32.11 | 0.89 |
| Com. Ex. 9 | $(Nd_{0.80}Y_{0.20})_2Fe_{14}B$ | 0.2 | 1.0 | 1.0E−02 | 800 | 1217 | 1047 | 30.70 | — |
| Com. Ex. 10 | $(Nd_{0.60}Y_{0.40})_2Fe_{14}B$ | 0.4 | 1.0 | 1.0E−02 | 800 | 1160 | 1075 | 31.11 | — |
| Com. Ex. 11 | $(Nd_{0.50}Y_{0.50})_2Fe_{14}B$ | 0.5 | 1.0 | 1.0E−02 | 800 | 1158 | 1059 | 31.11 | — |
| Com. Ex. 12 | $(Nd_{0.40}Y_{0.60})_2Fe_{14}B$ | 0.6 | 1.0 | 1.0E−02 | 800 | 1096 | 889 | 31.52 | — |
| Com. Ex. 13 | $(Nd_{0.30}Y_{0.70})_2Fe_{14}B$ | 0.7 | 1.0 | 1.0E−02 | 800 | 978 | 782 | 31.75 | — |
| Com. Ex. 14 | $(Nd_{0.50}Ce_{0.50})_2Fe_{14}B$ | 0.5 | 0.0 | 1.0E+00 | 600 | 645 | 296 | 34.38 | 0.49 |
| Com. Ex. 15 | $(Nd_{0.50}Ce_{0.50})_2Fe_{14}B$ | 0.5 | 0.0 | 1.0E−01 | 600 | 651 | 275 | 35.31 | 0.54 |
| Com. Ex. 16 | $(Nd_{0.50}Ce_{0.50})_2Fe_{14}B$ | 0.5 | 0.0 | 5.0E−02 | 600 | 702 | 299 | 35.24 | 0.65 |
| Com. Ex. 17 | $(Nd_{0.50}Ce_{0.50})_2Fe_{14}B$ | 0.5 | 0.0 | 2.0E−02 | 600 | 655 | 416 | 35.74 | 0.67 |
| Com. Ex. 18 | $(Nd_{0.50}Ce_{0.50})_2Fe_{14}B$ | 0.5 | 0.0 | 5.0E−05 | 600 | 549 | 517 | 35.89 | 0.81 |
| Com. Ex. 19 | $(Nd_{0.50}Ce_{0.50})_2Fe_{14}B$ | 0.5 | 0.0 | 1.0E−02 | 800 | 619 | 438 | 35.48 | 0.70 |
| Com. Ex. 20 | $(Nd_{0.50}Ce_{0.50})_2Fe_{14}B$ | 0.5 | 0.0 | 1.0E−02 | 700 | 735 | 503 | 34.87 | 0.70 |
| Com. Ex. 21 | $(Nd_{0.50}Ce_{0.50})_2Fe_{14}B$ | 0.5 | 0.0 | 1.0E−02 | 500 | 774 | 547 | 35.52 | 0.70 |
| Com. Ex. 22 | $(Nd_{0.50}Ce_{0.50})_2Fe_{14}B$ | 0.5 | 0.0 | 1.0E−02 | 400 | 712 | 487 | 35.11 | 0.70 |
| Com. Ex. 23 | $(Nd_{0.5}Y_{0.25}Ce_{0.25})_2Fe_{14}B$ | 0.5 | 0.5 | 1.0E−02 | 800 | 896 | 757 | 33.97 | 0.73 |
| Com. Ex. 24 | $(Nd_{0.5}Y_{0.25}Ce_{0.25})_2Fe_{14}B$ | 0.5 | 0.5 | 1.0E−02 | 700 | 1004 | 870 | 34.15 | 0.79 |
| Com. Ex. 25 | $(Nd_{0.5}Y_{0.25}Ce_{0.25})_2Fe_{14}B$ | 0.5 | 0.5 | 1.0E−02 | 500 | 1012 | 720 | 34.49 | 0.81 |
| Com. Ex. 26 | $(Nd_{0.5}Y_{0.25}Ce_{0.25})_2Fe_{14}B$ | 0.5 | 0.5 | 1.0E−02 | 400 | 899 | 611 | 34.38 | 0.77 |

As set forth above, the R-T-B based permanent magnet of the present invention is useful for field system of a permanent magnet synchronous rotating machine that is widely used in consumer, industry, transportation equipment.

What is claimed is:

1. A R-T-B based permanent magnet, comprising main phase grains with a composition of $(R_{1-x}(Ce_{1-z}Y_z)_x)_2T_{14}B$, wherein the abundance ratio of $Ce_{4f}/(Ce_{4f}+Ce_{4g})$ satisfies $0.83 \leq Ce_{4f}/(Ce_{4f}+Ce_{4g}) \leq 1.0$ when the Ce occupying the 4f site of the tetragonal $R_2T_{14}B$ structure in the main phase grains is denoted as $Ce_{4f}$ and the Ce occupying the 4g site is denoted as $Ce_{4g}$, wherein R is rare earth element(s) consisting of one or more elements selected from La, Pr, Nd, Sm, Eu, Gd, Tb, Dy, Ho, Er, Tm, Yb and Lu, T is one or more transition metal elements with Fe or Fe and Co as essential elements, $0.0<x\leq 0.5$ and $0.0\leq z\leq 0.5$.

2. A rotating machine, comprising the R-T-B based permanent magnet according to claim 1.

* * * * *